US005444970A

United States Patent [19]

Kobayashi et al.

[11] Patent Number: 5,444,970

[45] Date of Patent: Aug. 29, 1995

[54] SPINDLE DIRECTLY DRIVEN BY MOTOR AND TEXTILE MACHINE USING SAME

[75] Inventors: Hideaki Kobayashi, Sakura; Hidekazu Matsui, Funabashi, both of Japan

[73] Assignee: Hitachi, Ltd., Tokyo, Japan

[21] Appl. No.: 74,483

[22] Filed: Jun. 11, 1993

Related U.S. Application Data

[63] Continuation of Ser. No. 802,728, Dec. 5, 1991, abandoned.

[30] Foreign Application Priority Data

Dec. 5, 1990 [JP] Japan ..... 2-400452

[51] Int. Cl.[6] ..... D01H 7/00

[52] U.S. Cl. ..... 57/100; 310/112

[58] Field of Search ..... 57/100; 310/112, 67 R, 310/52, 59, 89

[56] References Cited

U.S. PATENT DOCUMENTS

| | | | |
|---|---|---|---|
| 1,658,701 | 2/1928 | Berlinerblau | 57/100 |
| 1,840,642 | 1/1932 | Stone | 57/100 |
| 2,714,712 | 4/1956 | Lonnquist | 310/112 |
| 4,142,120 | 2/1979 | Hallerback | 310/59 |
| 4,348,860 | 9/1982 | Hartmannsgruber | 57/100 |
| 4,534,686 | 8/1985 | Nakamura et al. | 310/59 X |
| 4,626,725 | 12/1986 | Kawada et al. | 310/89 |
| 4,943,746 | 7/1990 | Scherzinger et al. | 310/59 X |
| 5,088,362 | 2/1992 | Schalles | 310/59 X |

FOREIGN PATENT DOCUMENTS

| | | | |
|---|---|---|---|
| 23530 | 7/1935 | Australia | 310/89 |
| 0344472 | 4/1989 | European Pat. Off. . | |
| 702506 | 9/1930 | France | 310/52 |
| 123139 | 8/1926 | Switzerland . | |
| 728199 | 4/1980 | U.S.S.R. | 310/52 |

*Primary Examiner*—Daniel P. Stodola

*Attorney, Agent, or Firm*—Antonelli, Terry, Stout & Kraus

[57] ABSTRACT

At least two corners of a basical rectangle, as seen from the top of a spindle, are bevelled so as not to come into contact with each other. As a result, such spindles can be easily installed on a textile machine by using the same spindle gages, without increasing the accuracy with which the spindles are installed.

14 Claims, 12 Drawing Sheets

SPINDLE DIRECTLY DRIVEN BY MOTOR AND TEXTILE MACHINE USING SAME

This is a continuation of application Ser. No. 07/802,728 filed Dec. 5, 19991, now abandoned.

BACKGROUND OF THE INVENTION

The present invention relates to a spindle, directly driven by a motor, for use in a machine, such as a ring spinning machine or a twister and more particularly, a spindle shaped so that intervals at which the spindles are installed can be used efficiently, and to a textile machine using such spindles.

In textile machines such as ring spinning machines, generally, several hundred spindles are aligned horizontally on a spindle rail. Because of the many aligned spindles, intervals (spindle gages G) at which the spindles are installed considerably and directly affect the area where the textile machines are installed. It it thus necessary to narrow the spindle gage G to reduce such an area as much as possible, whereby the entire textile machine can be made smaller.

A type of spindle, whose shaft is directly driven by a spindle motor, (hereinafter referred to simply as a spindle) has been frequently used in recent years. A power line connector to the spindle motor and accessories (such as a start/stop switch) are attached to such a spindle. Because it is required to reduce the area where the textile machine is installed, these components must not be attached on a surface of the spindle which faces another spindle, but be attached on a surface of the spindle which does not face another spindle. The textile machine is employed in an environment where there is a great amount of cotton and other types of dust, and therefore, the power line connector and accessories are covered to protect them from dust.

Japanese Patent Unexamined Publication No. 2-19521 discloses a spindle. The outline of this conventional spindle, as seen from the top of the spindle shaft thereof, is either a square corresponding to the shape of a spindle motor or a rectangle having a cover for accessories and other components. Such rectangular spindles are installed on a spindle rail so that one short side (width) of each spindle becomes parallel to the spindle rail and one long side (length) thereof becomes perpendicular to the spindle rail.

The gaps between the spindles thus installed are extremely narrow. FIG. 1 shows how conventional spindles are installed as seen from the tops of the spindle shafts thereof. In this drawing, each spindle is schematically shown by the outline thereof as seen from the top thereof. The outline of each spindle is composed of lines $a_1$ and 2, corresponding to long sides (lengths) $H_{16}$, and lines $b_1$ and $b_2$, correspond to short sides (widths) $W_{16}$, of each spindle. Symbol G indicates a spindle gage, and a circle $D_{16}$ indicates where the spindle motor is disposed. When a conventional spindle $\mathbf{1}_3$ having such an outward shape rotates on the spindle shaft, through even a small angle of only $\theta_{16}$, it interferes with the spindle $\mathbf{1}_2$ next to it.

Such narrow gaps between the spindles cause the following problems:

To prevent the spindles from interfering with each other, it is necessary not only to increase the accuracy with which the spindles are installed, but also to improve the degree to which the spindles are parallel to each other.

It is necessary to install the rectangular spindle onto the spindle rail so that the long sides of the spindle becomes accurately perpendicular to the spindle rail. This installation is troublesome and requires a considerable amount of time.

The area available to cool the spindle motor is small; consequently, the temperature of the motor may increase.

Because it is difficult for air to flow between the spindles, it is also difficult to remove cotton dust.

If all of the gaps between the spindles are equally widened, because of limited spindle gages, the size of the motor within the spindle becomes small, thereby decreasing the efficiency of the spindles.

SUMMARY OF THE INVENTION

An object of the present invention is to provide spindles which do not come into contact with each other, without increasing the accuracy with which the spindles are installed or improving the degree to which the spindles are parallel to each other, and, as a result, the spindles can be easily installed in a short period of time.

Another object of this invention is to provide a textile machine using such spindles.

To achieve the above objects, in accordance with one aspect of the present invention, there is provided a spindle directly driven by an electrical motor, a plurality of which are mounted on a spindle rail of a textile machine to constitute a row, characterized in that an outline of a periphery of an electrical motor body of said as viewed from an axial direction of said spindle, is included within a rectangle in a part of 20% and more of length of a long side of the rectangle. The rectangle is defined by short sides ($b_1$, $b_2$) parallel to an ideal straight line ($\alpha$) and respectively passing at a point where a distance from an axial center (o) of said spindle to said outline becomes maximum and long sides ($a_1$, $a_2$) perpendicular to said ideal straight line ($\alpha$) and longer than said short sides ($b_1$, $b_2$), one ($a_1$) of said long sides passing a point (p) and the other ($a_2$) passing another point (q) , wherein the point (p) comprises a point where a distance from the axial center (o) of the spindle to the outline becomes minimum and the other point (q) comprises a point disposed contrary to the point (p) with respect to the axial center (o) and the ideal straight line ($\alpha$) comprises a line passing through said points (p, q).

The spindles are installed on the spindle rail so that one short side (width) of each spindle becomes parallel to the spindle rail and one long side (length) thereof becomes perpendicular to the spindle rail.

The outward shape of the spindle is such that the width of the short side of the spindle is shorter than the maximum width. Therefore, the spindles can be installed without interfering with each other.

DESCRIPTION OF THE PREFERRED EMBODIMENTS

Figure 2:
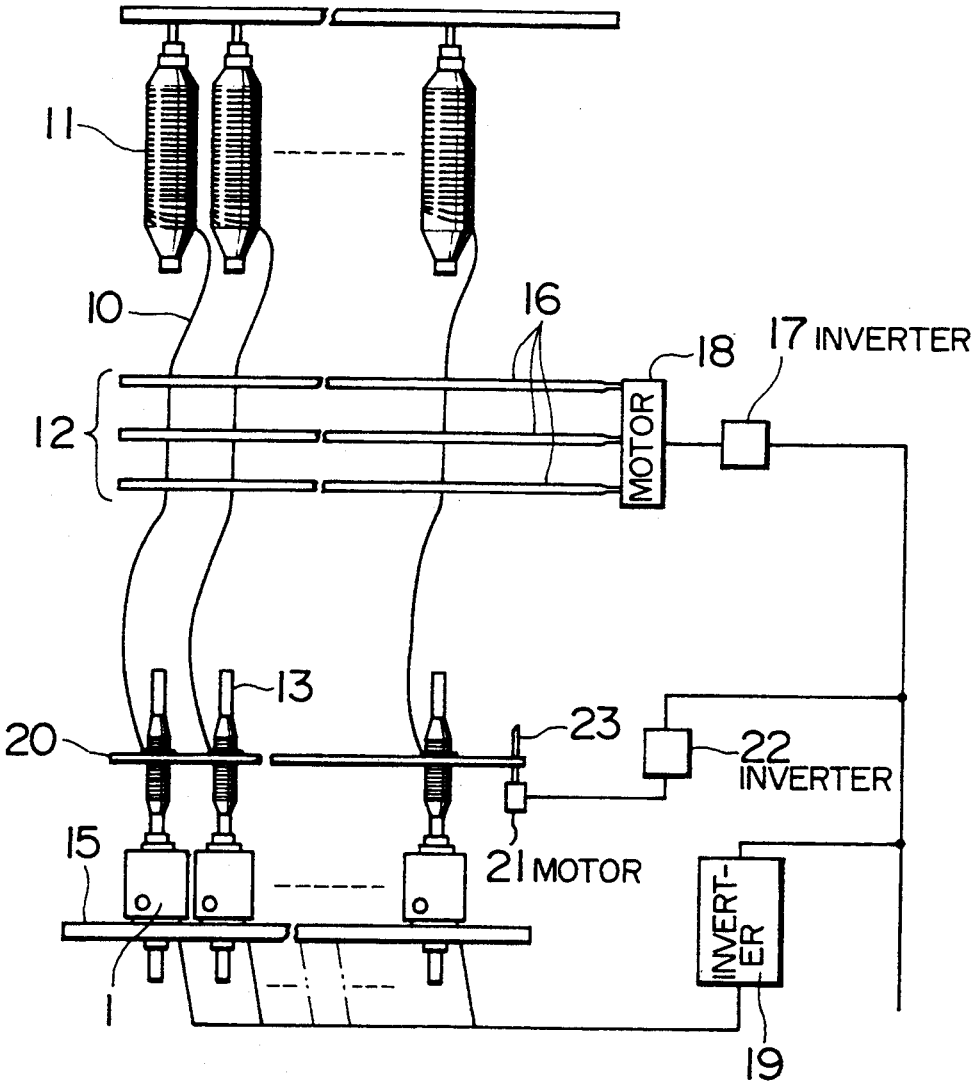
FIG. 2 is a view showing an embodiment of a textile machine using spindles according to the present invention.

FIG. 2 is a view showing an embodiment of a ring spinning machine, which is a textile machine. A roving 10 wound around a package 11 is stretched when it passes through a draft part 12. It then passes through a ring (not shown) of a ring rail 20, and is wound around a bobbin 13 on one of many spindles 1. The spindles 1 are spindles which are integral with and directly driven by spindle motors, and are arranged on a spindle rail 15. An inverter 19 controls the speed of the spindles 1. Draft rollers 16 of the draft part 12 are rotated by a motor 18, whose speed is controlled by an inverter 17. The ring rail 20 is moved back and forth by rotating a screw spindle 23 clockwise or counterclockwise, which spindle 23 is fixed on a motor 21. The speed of the motor 21 is controlled by another inverter 22.

Figure 3A:
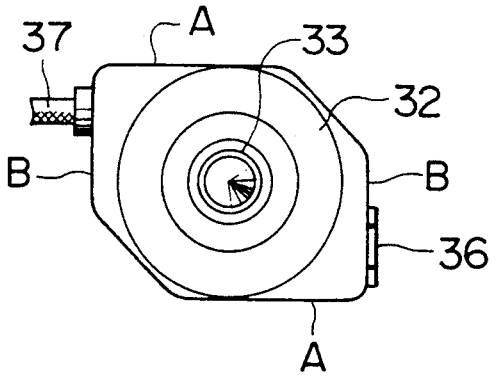
FIG. 3A is a plan view of a spindle according to the present invention.
Figure 3B:
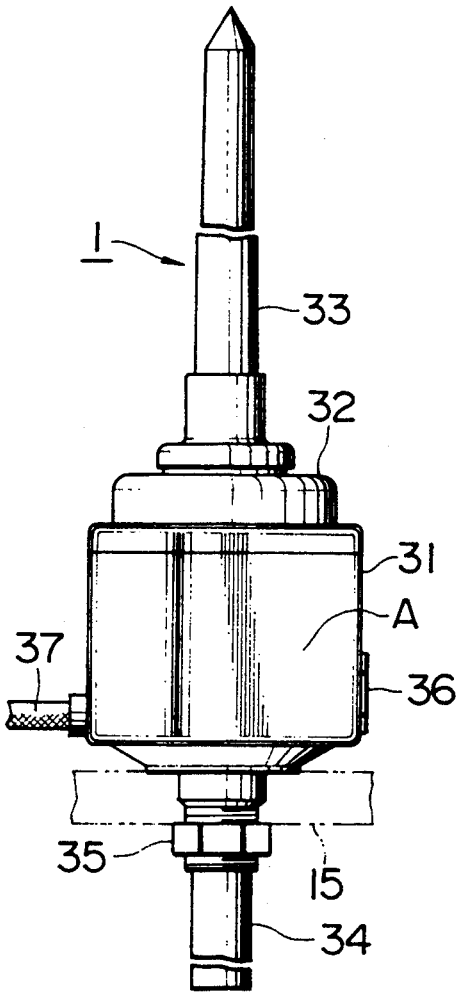
FIG. 3B is a side view as seen perpendicularly to a surface A in FIG. 3A.
Figure 3C:
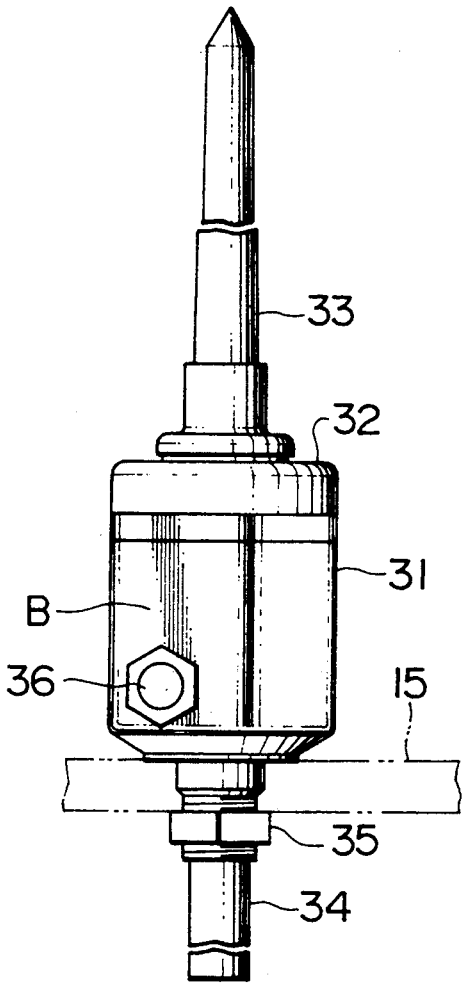
FIG. 3C is a side view as seen perpendicularly to a surface B in FIG. 3A.

Gaps are very narrow between the spindles of the thus-constructed ring spinning frame. Because of the narrow gaps, there have hitherto been problems mentioned previously with the conventional art. FIGS. 3A–3C shows an embodiment of a spindle, according to the present invention, which solves such problems.

Numeral 31 denotes a housing of the spindle motor, and numeral 32 denotes a bracket of the same motor. Numeral 33 denotes an upper blade constituting a portion of the spindle shaft. The upper blade 33 is tapered and becomes thinner as it approaches one end thereof. The upper blade 33 is inserted into a bobbin (not shown) for winding the roving. Numeral 34 denotes a bolster extending opposite to the upper blade 33. It covers a vibration-absorbing member absorbing virbrations caused by the spindle shaft and the rotation of the motor and other members. A switch 36 is disposed on the housing 31, which is used to start and stop the spindle 1 independently. A cable 37 including a power wire and a signal wire for the switch 36 extends from the housing 31. As shown in FIG. 3, the spindle 1 is fixed by a nut 35 to a hole bored in the spindle rail 15.

Figure 4:
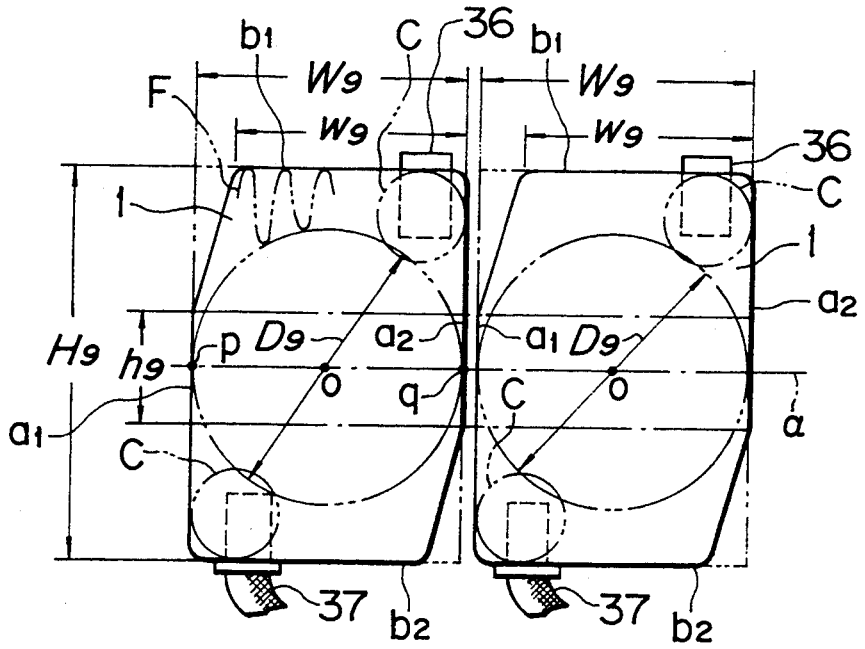
FIG. 4 is a plan view showing an embodiment of the present invention where the two diagonally opposing corners of each rectangle spindle are cut.

FIG. 4 is a simplified plan view showing the outlines of the spindles 1 as seen from the tops of the spindle shafts. Of the adjacent spindles 1, two spindles 1 are shown in this drawing. According to this embodiment the outlines of the spindles 1 form rectangles, as seen from the tops of the spindle shafts, with the two opposing corners bevelled. This is a unique feature of this invention, different from the conventional spindle which also forms the outline of a rectangle but with the four corners thereof left intact. As shown in FIG. 4, symbol $H_9$ indicates lengths of long sides of the rectangle (hereinafter referred to as maximum lengths), and symbol $W_9$ indicates widths of short sides (hereinafter called maximum widths). The spindle shaft and a motor shaft are disposed on the same center within a circle $D_9$ in contact with the long sides so that these two shafts form an integral structure. The outline of the spindle 1 is composed of lines drawn substantially along the long sides, lines drawn substantially along the short sides and lines drawn along the bevelled corners. Surfaces corresponding to these lines are not necessarily planes. Lines connecting outer edges of the surfaces form the outline of the spindle 1 shown in FIG. 4. The outward shape of the spindle 1 may be such that, for example, a cooling fin, have an uneven surface thereof, indicated by symbol F, is disposed in at least a part of the spindle 1. Symbol $h_9$ indicates a length of a portion of the long side, at which the width of the outline is the maximum width $W_9$.

Figure 1:
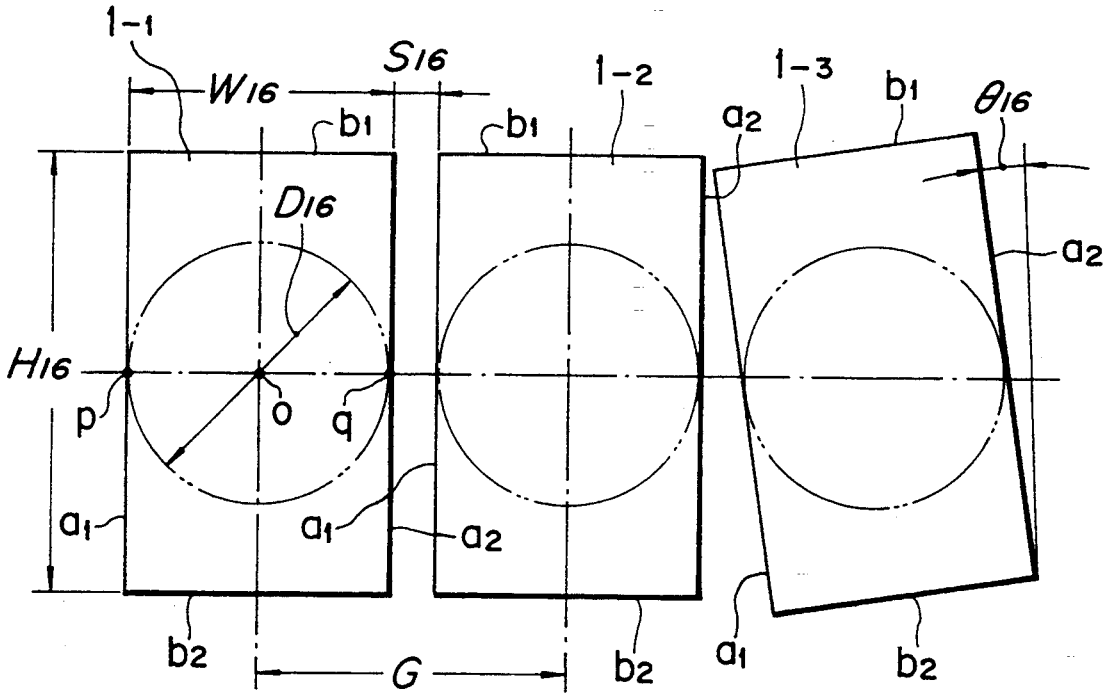
FIG. 1 PRIOR ART
FIG. 1 is a plan view showing how the conventional spindles are installed as seen from the tops of the spindle shafts thereof.
Figure 5:
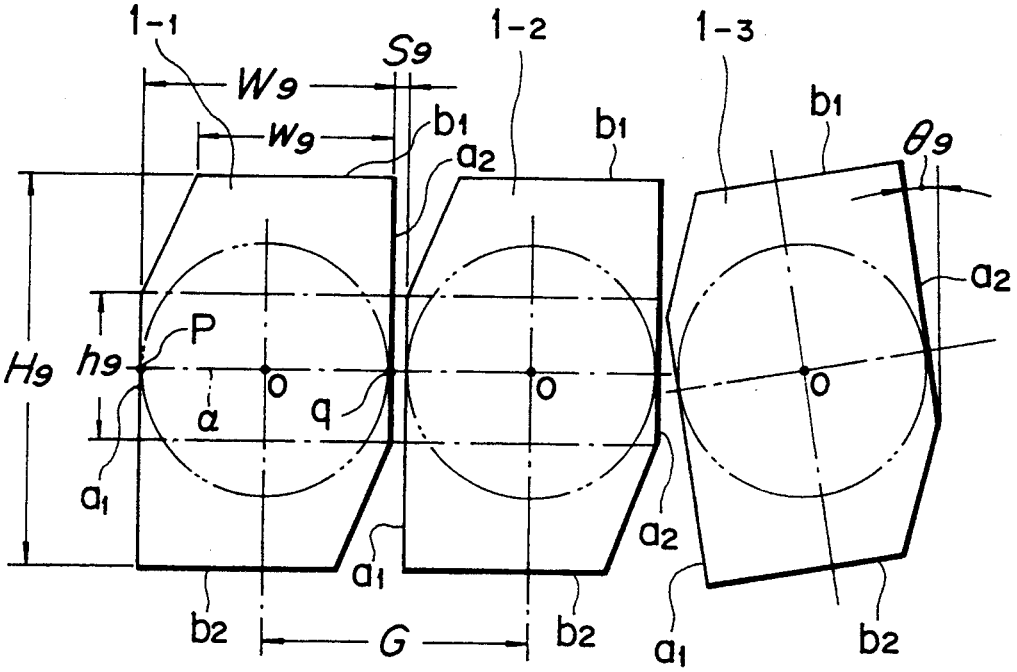
FIG. 5 is a plan view showing how the spindles, each having the outward shape shown in FIG. 4, are installed.

FIG. 5 is a plan view where a spindle $\mathbf{1}_{-3}$ is inclined through an angle of only $\theta_9$ while the spindles, each having the shape shown in FIG. 3 or FIG. 4, are installed and stand upright on the machine. As shown in FIG. 1, the outline of the conventional spindle forms a rectangle as seen from the top of the spindle shaft. (Symbol $H_9$ indicates the length, and symbol $W_9$ indicates the width of the rectangle). Because of such an outline, even when a spindle $\mathbf{1}_{-3}$ rotates slightly through an angle of $\theta_{16}$, it interferes with the spindle $\mathbf{1}_{-2}$ next to it. However, according to this embodiment, as shown in FIG. 5, the two corners of each spindle are bevelled so that the length $w_9$ of their short sides becomes shorter than the maxim width $W_9$. Due to this outline, even when the spindle $\mathbf{1}_{-3}$ rotates, there is more gap where the spindles are not in contact with each other than in the case of the conventional art. In other words, the following relationship can be established between the rotation angles $\theta_9$ and $\theta_{16}$:

$$\theta_9 > \theta_{16}$$

The following relationship can be obtained between the maximum length $H_9$ and the length $h_9$:

$$H_9 > h_9$$

If, for example, a spindle gage G is 75 mm; the gap $S_9$ between the spindles is 4 mm; the maximum length $H_9$ is 100 mm; the ratio $h_9/H_9$ of the length $h_9$ to the maximum length $H_9$ is $\frac{1}{3}$; and the ratio $w_9/W_9$ of the width $w_9$ to the maximum width $W_9$ is $\frac{2}{3}$, then, the angle $\theta_{16}$ is approximately 4.7°, and the angle $\theta_9$ is approximately 37°. Thus, the spindle according to this embodiment shown in FIGS. 3A–3C or 4 is capable of inclining eight times as much as the conventional spindle. In other words, the gap $S_9$ between the spindles shown in FIG. 5 can be made smaller than the gap $S_{16}$ between the conventional spindles shown in FIG. 1. Thus, even when the spindle gage G is the same, the maximum width $W_9$ of the spindle can be increased, and the size of an electrical portion of the motor can also be increased. Consequently, the size of the motor can be reduced, and the efficiency of the motor can be improved. When spindles each having, for instance, the above sizes are arranged, it is possible to set the gap $S_9$ between the spindles to 1 to 1.5 mm. That is, the ratio $S_9/S_{16}$ of the gap $S_9$ according to this embodiment to the gap $S_{16}$ of the conventional spindles can be set at $\frac{1}{4}$ to $\frac{1}{3}$. In such a case, it is possible to increase the outward size of an iron core of the motor by 3 to 5%, and to improve the efficiency thereof by 1 to 3%. Because of the widened gap $S_9$ between the spindles, the spindles become well-ventilated and the cooling efficiency thereof can be improved. As a result, it is possible to reduce an increase in the temperature of the motor. When the ratio $h_9/H_9$ of the length $h_9$ to the maximum length $H_9$ is approximately 0.8 or less, the ratio is practical and an advantageous effect can be obtained.

Figure 6:
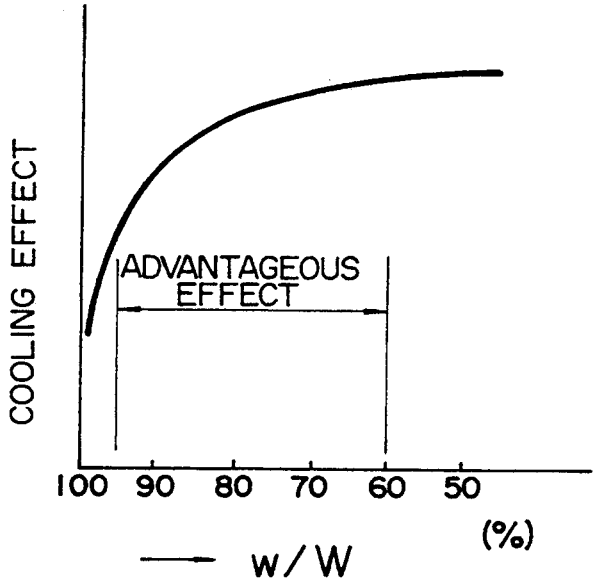
FIG. 6 is a graphical illustration depicting cooling effect when the ratio w/W of the minimum width w to the maximum width W of the spindle changes.

FIG. 6 is a graph showing cooling effect when the ratio $h_9/H_9$ is $\frac{1}{3}$ and when the ratio $w_9/W_9$ of the width $w_9$ to the maximum width $W_9$ changes. When attaching the switch and extending a lead-out wire are considered, the cooling effect improves where the ratio $w_9/W_9$ (indicated by w/W in FIG. 6) ranges from 0.95 to 0.6.

Cotton and other types of dust collect between the spindles and on other places, and therefore, wind is blown to remove it. However, according to this embodiment, because of the widened gap between the spindles, wind smoothly flows into the gap, thus effectively removing dust.

As shown in FIG. 4, because the two diagonally opposing corners of the outline of the spindle 1 are bevelled as seen from the top of the spindle shaft, the other two diagonal corners C which are not bevelled can be used for attaching accessories 36 or for leading the cable 37.

Then, another embodiment of the invention will be explained with reference to FIGS. 7 and 8.

An outline of the spindle 1 is located within a rectangle of which length of long sides in referred as $H_{17}$ and length of short sides is referred as $W_{17}$. The outline of the spindle comprises a shape of which all of the four corners of the rectangle are bevelled. Symbol $h_{17}$ incidates a length of a portion of the outline, at which the width of the outline is a maximum width $W_{17}$. Symbol $w_{17}$ indicates the width of the short side of the outline. The spindle shaft and a motor shaft are disposed on the same center within a circle $D_{17}$ in contact with the long sides $a_1$ and $a_2$ so that these two shafts form an integral structure. The outline of the spindle 1 is composed of lines drawn substantially along the long sides, lines drawn substantially along the short sides, and lines drawn substantially along the four bevelled corners. Surfaces corresponding to these lines are not necessarily planes. Lines connecting outer edges of the surfaces form the outline of the spindle 1 shown in FIG. 7. The outward shape of the spindle 1 may be such that, for example, a cooling fin, have an uneven surface thereof indicated by symbol F, is disposed in at least a portion of the spindle 1.

Figure 7:
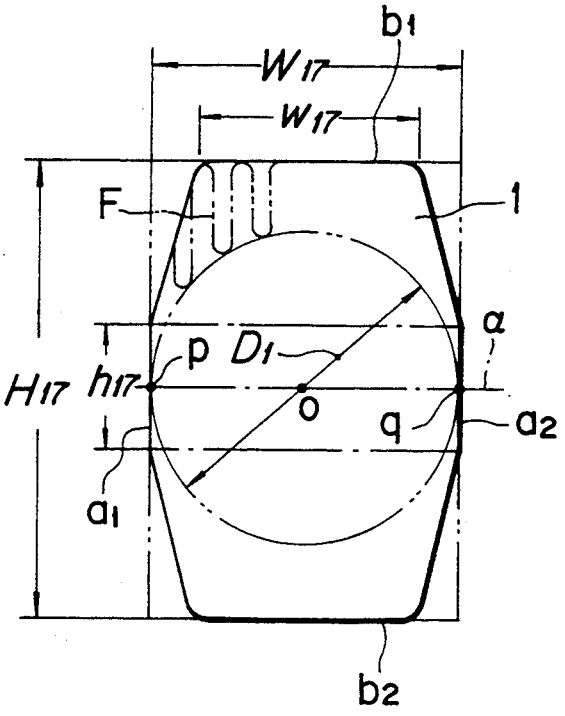
FIG. 7 is a plan view showing an embodiment of a spindle according to the present invention, in which all corners of the originally rectangular spindle are cut.
Figure 8:
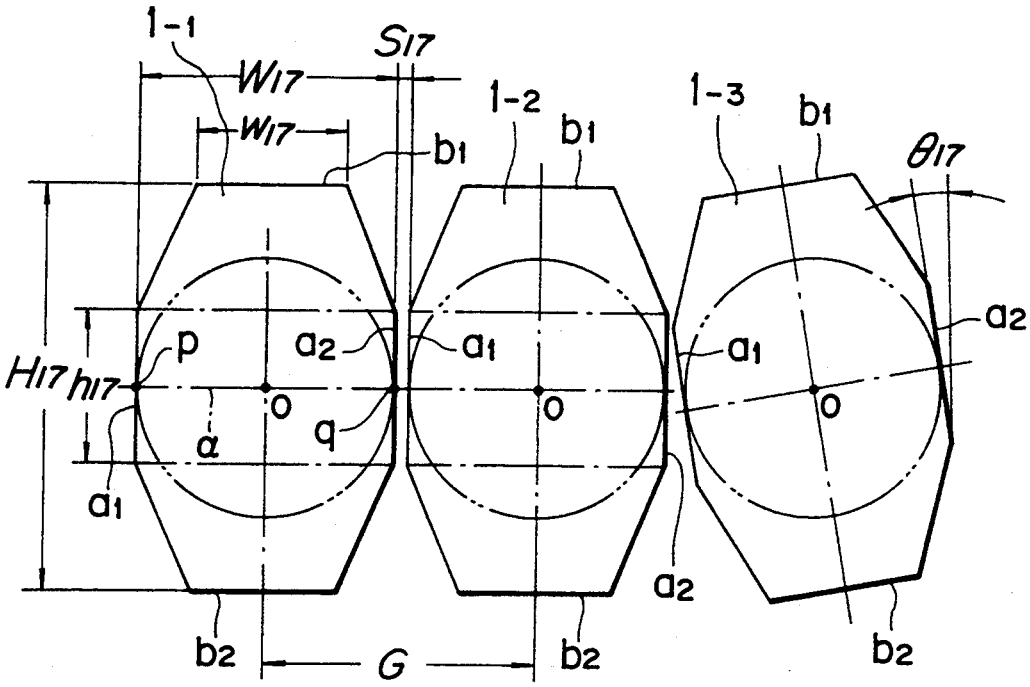
FIG. 8 is a plan view showing how the spindles, each having the outward shape shown in FIG. 7, are installed.

FIG. 8 is a plan view partially showing how the spindles, each having the outward shape shown in FIG. 7 as seen from the tops of the spindle shafts thereof, are installed on a machine. As shown in this drawing, all four corners of each spindle 1 are bevelled so that the length $h_{17}$ is shorter than the length $H_{17}$ of the long side of each spindle 1. Because of the four bevelled corners, there is more gap between the spindles than in the case of the conventional art, even when a spindle $\mathbf{1}_{-3}$ inclines. In the same way as in the embodiment shown in FIG. 4, the following relationship can be established between the rotation angles $\theta_{16}$ and $\theta_{17}$ $$\theta_{17} > \theta_{16}$$

Thus this embodiment maskes it possible for the gap between the spindles to be almost as wide as the gap in the embodiment shown in FIG. 4.

In the same manner as in the embodiment shown in FIG. 4, when the ratio $h_{17}/H_{17}$ of the length $h_{17}$ to the maximum length $H_{17}$ is approximately 0.8 or less, such a ratio is practical and an advantageous effect can be obtained. When the ratio $w_{17}/W_{17}$ of the width $w_{17}$ to a maximum width $W_{17}$ ranges from 0.95 to 0.6, the spindles can be effectively employed.

In this embodiment, because there is more gap between the spindles than in the case of the conventional art, air flows smoothly in the same way as in the embodiment shown in FIG. 4, and thus cotton and other types of dust can be effectively removed.

FIGS. 9 through 15 show modifications of the embodiment shown in FIG. 7, in which the four corners of each rectangle are all bevelled.

Figure 9:
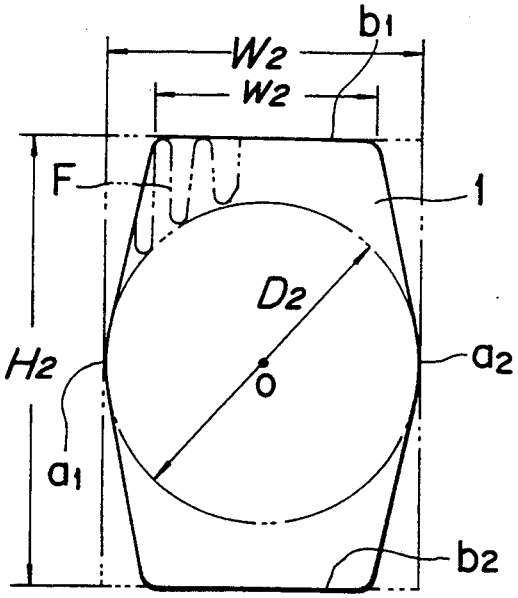
FIG. 9 is a plan view showing an embodiment of a spindle according to the present invention, in which all corners of the originally rectangular spindle are cut, and a portion of a circle is used to form the surfaces A.
Figure 10:
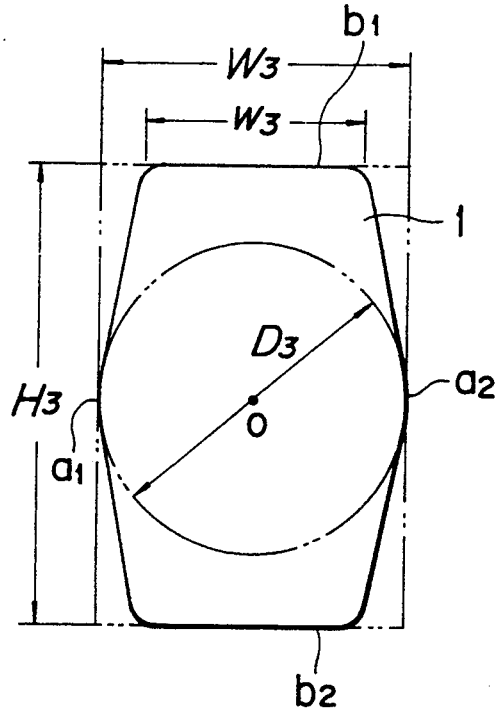
FIG. 10 is a plan view showing an embodiment of a spindle according to the present invention, in which all corners of the originally rectangular spindle are cut, and the surfaces A are in contact with a circle.

Spindles shown in FIGS. 9 and 10 are spindles each having no length corresponding to the length $h_{17}$ of the spindle 1 shown in FIG. 7.

An outline of the spindle 1 shown in FIG. 9 is shaped in such a manner that a circle having a diameter $D_2$ which is equal to a maximum width $W_2$ is drawn so that a part of this circle corresponds to a part of the outline of the spindle 1. The spindle 1 has no straight line corresponding to the length $h_{17}$ of a portion of the spindle 1 where the width of the spindle 1 is the maximum width $W_2$. In this embdoiment, permissible angle for mounting the spindles becomes larger than the embodiment of FIG. 7, and the gap between the spindles can be widened; consequently, the spindles are more effectively cooled.

An outline shown in FIG. 10 has no straight line corresponding to the length $h_{17}$ of a portion of the spindle 1, at which the width of the spindle 1 is a maximum width $W_3$ in the same way as in the embodiment illustrated in FIG. 9. However, the lines of the bevelled corners are in contact with a circle $D_3$. In other words, the diameter of the circle $D_3$ is shorter than the maximum width $W_3$. The same advantageous effect as that described in the embodiment shown in FIG. 9 can be obtained.

Figure 11:
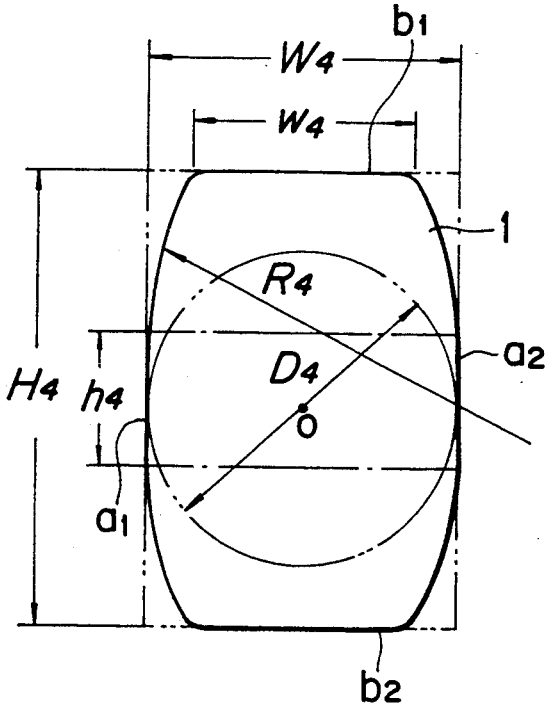
FIG. 11 is a plan view showing an embodiment of a spindle according to the present invention, in which all corners of the originally rectangular spindle are cut, and a part of a circle is used to connect portions of short sides of the spindle to portions of the long sides of the spindle which the width of the spindle is the maximum width.

An outline shown in FIG. 11 is similar to that shown in FIG. 7. An outline of the spindle comprises lines of which length is referred as $w_4$ on the short sides, lines of which length is referred as $h_4$ on the long sides and line portions connecting the lines of the short sides and the lines on the long sides. The line portions are a part of a circle of which radius is $R_4$. The spindle 1 in this embodiment has a wider outer periphery thereof than the spindle 1 in the embodiment shown in FIG. 7, and is therefore cooled effectively.

Figure 12:
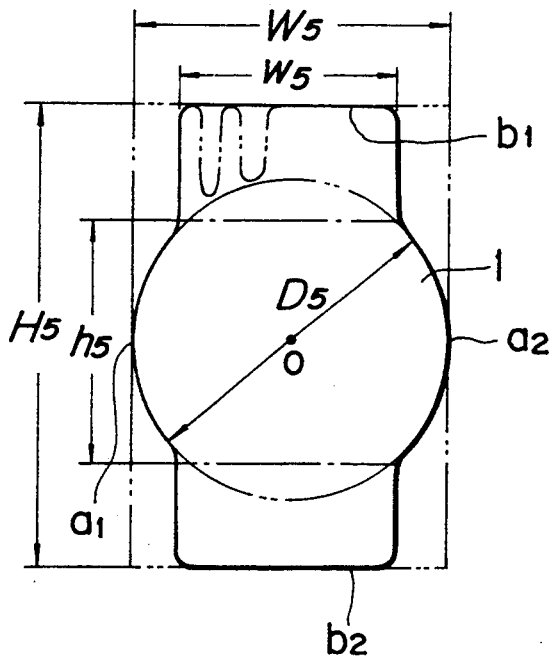
FIG. 12 is a plan view showing an embodiment of a spindle according to the present invention, in which all corners of the originally rectangular spindle are cut, and the outward shape of the spindle is a combination of a part of a circle and a part of the rectangle.

An outline of an embodiment shown in FIG. 12 is a combination of a rectangle comprising long sides having a length $H_5$ and short sides having a length $w_5$ and portions of a circle having a diameter $D_5$. A gap between adjacent spindles can be widened closer to a center portion than the embodiments shown in FIGS. 4, 7 and 9–11. The cooling effect is further increased.

Figure 13:
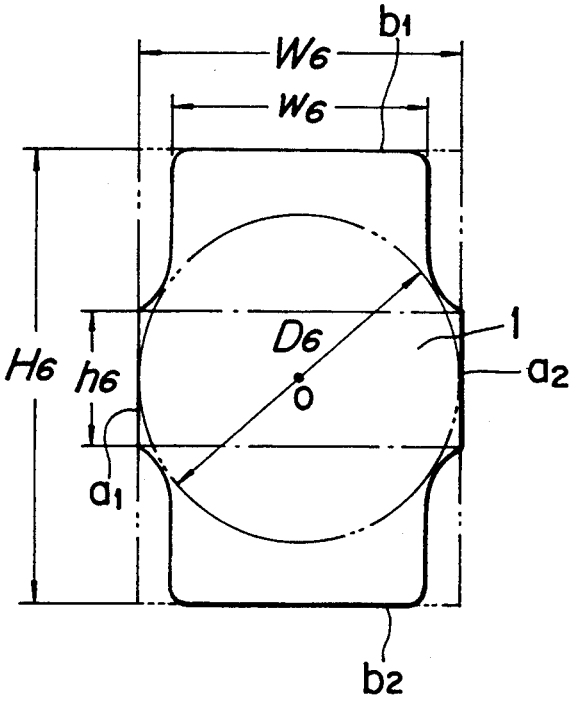
FIG. 13 is a plan view showing an embodiment of a spindle according to the present invention, in which all corners of the originally rectangular spindle are cut, and the outward shape of the spindle is a combination of rectangles.

An outline of an embodiment shown in FIG. 13 is a combination of a rectangle of which long sides have a length $H_6$ and short side have a length $w_6$ and another rectangle of which long sides have a length $W_6$ and short sides have a length $h_6$. The cooling effect of this embodiment is substantially the same as the embodiment shown in FIG. 12 but it is suitable for a case in which the length $w_6$ is made larger than the length $w_5$.

Figure 14:
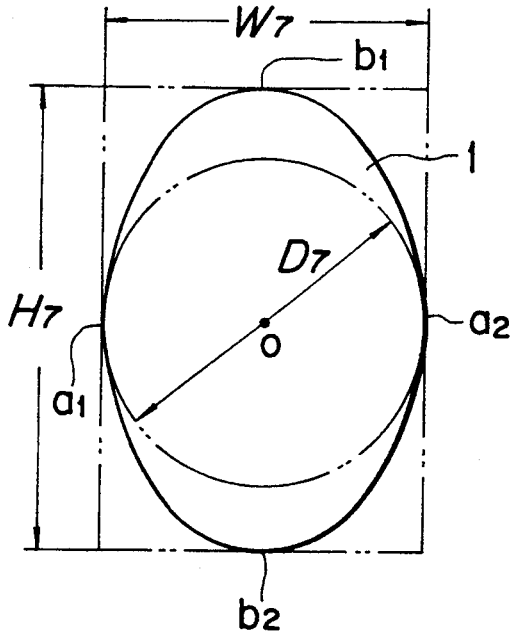
FIG. 14 is a plan view showing an embodiment of a spindle according to the present invention, in which all corners of the originally rectangular spindle are cut so as to correspond to the shape of an ellipse.

An outline of an embodiment shown in FIG. 14 comprises an ellipse of which a major axis has a length corresponding to a length $H_7$ of long sides of a rectangle and a minor axis has a length corresponding to a length $W_7$ of short sides of the rectangle. According to the present embodiment, permissible angle for mounting can be increased and the irregularity of a spindle arrangement after mounted is inconspicuous.

Figure 15:
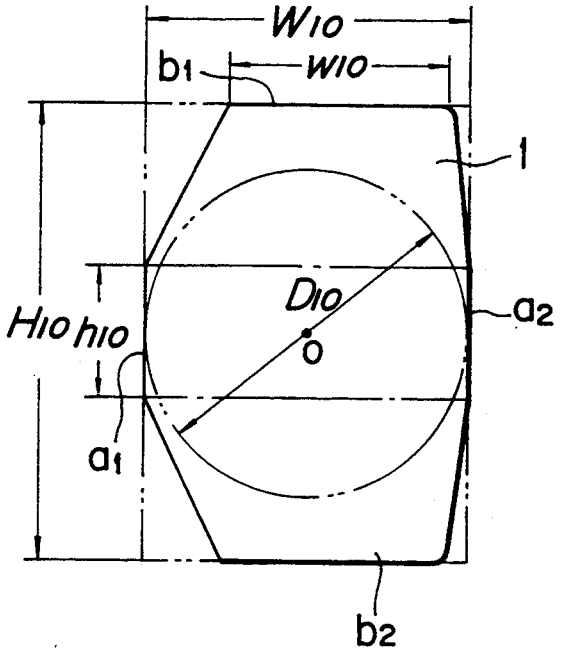
FIG. 15 is a plan view showing an embodiment of a spindle according to the present invention, in which all corners of the originally rectangular spindle are cut, and a degree to which two corners of one long side of the spindle are cut differs from a degree to which two corners of another long side of the spindle are cut.

In an outline of an embodiment shown in FIG. 15, a bevelled amount of one side of the surface A is different from those of the other side. In the present embodiment, it is possible to use the small bevelled amount corners for connecting lead wires to the motor and for mounting accessaries.

Figure 16:
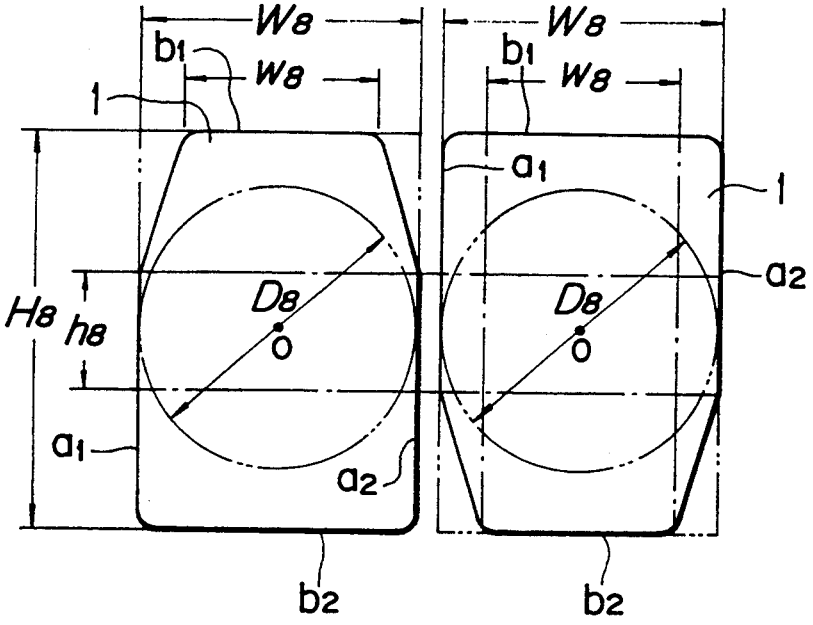
FIG. 16 is a plan view showing an embodiment of a spindle according to the present invention, in which spindles, whose two corners of one short side thereof are cut, are alternately disposed.

In an outline of an embodiment shown in FIG. 16, two corners on one of short sides of the rectangle are bevelled. In the present embodiment, the spindles are alternately disposed with different attitude as shown in FIG. 16. Also in the present embodiment, the same advantages as those of the previously explained embodiments can be obtained.

FIGS. 17 to 21 show embodiments shaped so as to be unsymmetrical with respect to longitudinal axis running at a center of the spindle shaft.

Figure 17:
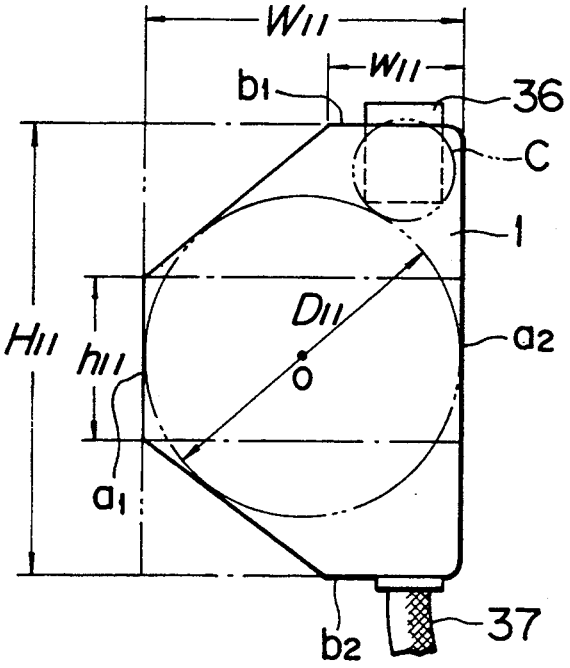
FIG. 17 is a plan view showing an embodiment of a spindle according to the present invention, in which the two corners of the originally rectangular spindle are cut and accessaries are attached to the spindle.

In an outline of an embodiment shown in FIG. 17, two corners on one of long sides of the rectangle are bevelled with straight lines in the same manner as those of one side in the embodiment shown in FIG. 7.

Figure 18:
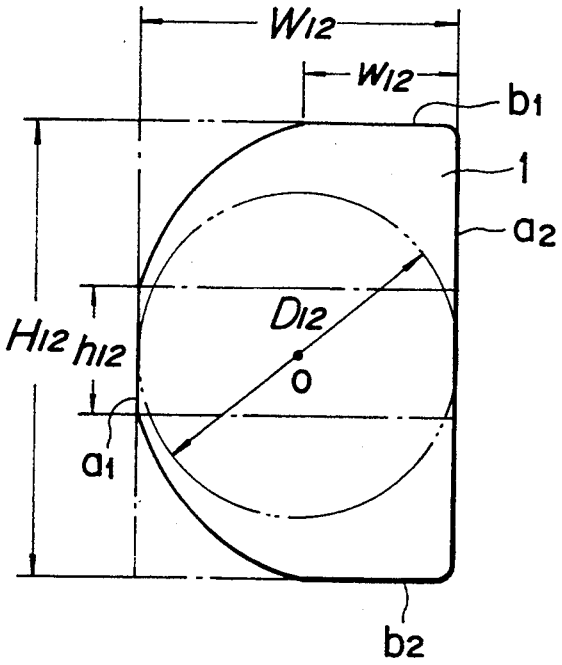
FIG. 18 through FIG. 21 are plan views each showing an embodiment of a spindle according to the present invention, in which two corners of one long side of the originally rectangular spindle are cut.

In an outline of an embodiment shown in FIG. 18, two corners on one of long sides of the rectangle are bevelled with a part of a circle in the same manner as those of one side in the embodiment shown in FIG. 11.

Figure 19:
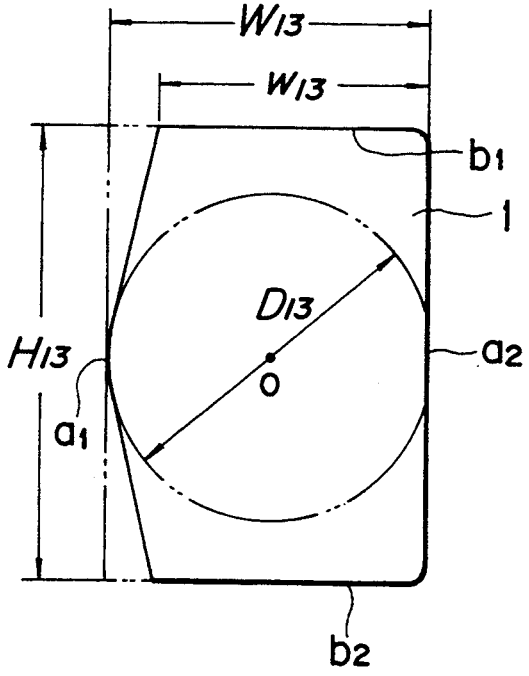

In an outline of an embodiment shown in FIG. 19, two coroners on one of long sides of the rectangle are bevelled with a part of circle having a diameter $D_2$ equal to the maximum width $W_2$ of the spindle in the same manner as those of one side in the embodiment shown in FIG. 9.

Figure 20:
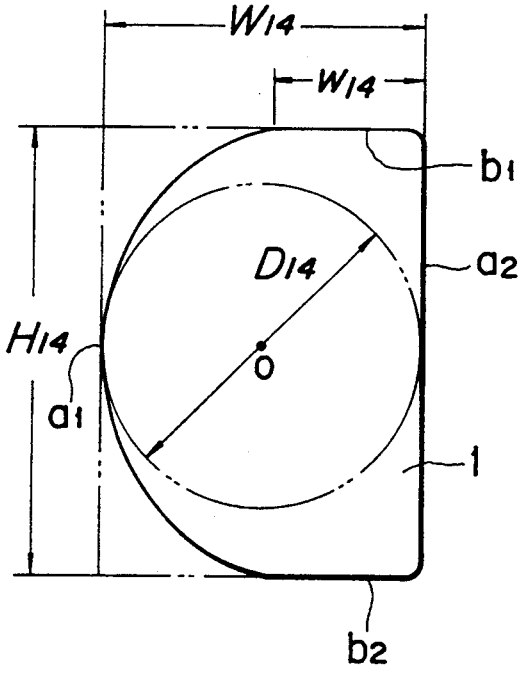

In an outline of an embodiment shown in FIG. 20, two corners on one of long sides of the rectangle are bevelled with a part of an ellipse in the same manner as those of one side in the embodiment shown in FIG. 12.

Figure 21:
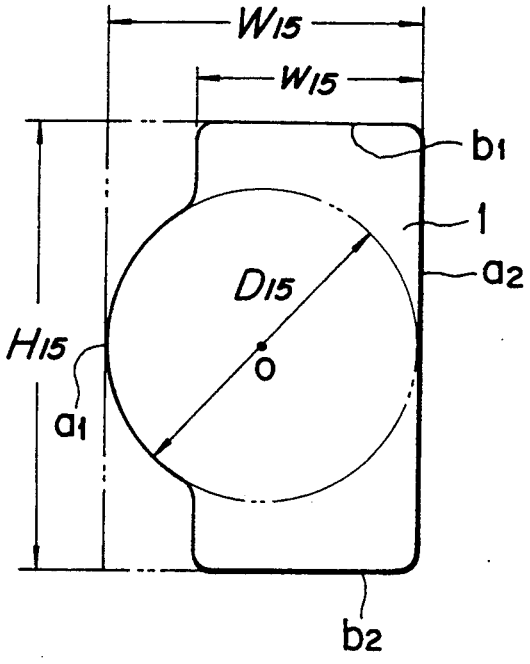

In an outline of an embodiment shown in FIG. 21, two corners on one of long sides of the rectangle are bevelled with a part of a circle $D_{15}$ and a part of a rectangle having a long side $H_{15}$ and a short side $w_{15}$ in the same manner as those of one side in the embodiment shown in FIG. 12.

Only the two opposing corners of one long side of each spindle 1 are bevelled in all the embodiments shown in FIGS. 17 through 21. For this reason, the other two corners C of each spindle 1 can be used for attaching accessories 36 or leading the cable 37 in the same manner as in the embodiment shown in FIG. 4 described above.

As is apparent from the description of the embodiments hereinbefore, according to the present invention, it is possible to mount the spindles so as not to come into contact with each other without increasing the mounting accuracy of the spindles and the parallel accuracy of the surfaces of adjacent spindles facing to each other. Therefore, spindles which are easily mounted with less operational time and a textile machine using the spindles can be provided.

What is claimed is:

1. A spindle assembly comprising a plurality of spindles, each of said spindles being directly driven by a respective electrical motor having an electrical motor body, means for mounting said plurality of spindles on a spindle rail of a textile machine so as to form a row of adjacent spindles in such a manner that each electrical motor body is subject to slight axial rotation relative to the spindle rail over a period of time of use, wherein each electrical motor body has a pair of side surfaces with said spindles being disposed on said spindle rail with one side surface of one electrical motor body being disposed in opposition to one side surface of an adjacent electrical motor body, and wherein a portion of at least one side surface of the electrical motor body of each spindle is directed away from said adjacent electrical motor body along the overall length thereof in the axial direction so that an electrical motor body of one spindle which rotates through said slight axial rotation relative to the spindle rail will not interfere or come into contact with the electrical motor body of an adjacent spindle.

2. A spindle assembly according to claim 1, wherein two portions of each of the side surfaces of the pair of said surfaces of each of the respective electrical motor bodies are directed away from an adjacent electrical motor body along the overall length of the respective electrical motor bodies in the axial direction thereof.

3. A spindle assembly according to claim 1, wherein only one portion of each of the side surfaces of the pair of said surfaces of the respective electrical motor bodies is directed away from an adjacent electrical motor body along the overall length of the respective electrical motor body in the axial direction thereof, and wherein said portions are symmetrical with respect to an axial center of said electrical motor body.

4. A spindle assembly according to claim 1, wherein two portions of only one of said pair of side surfaces of each electrical motor body is directed away from an adjacent electrical motor body along the overall length of the respective electrical motor bodies in the axial direction thereof.

5. A spindle assembly comprising a plurality of spindles, being directly driven by a respective electrical motor having an electrical motor body, and means for mounting said plurality of spindles on a spindle rail of a textile machine so as to form a row of adjacent spindles in such a manner that each electrical motor body is subject to slight axial rotation relative to the spindle rail over a period of time of use, wherein an outline of a periphery of the electrical motor body of each of said spindles, as viewed in an axial direction of the respective spindles, is included within a rectangle defined by:

short sides parallel to an ideal straight line passing through an axial center of said spindle, said short sides defining a maximum width of said outline, and long sides having a length longer than said short sides, one of said long sides passing through a first point and having a first portion perpendicular to said ideal straight line and at least one second portion inclined with respect to said ideal straight line in a direction away from an adjacent spindle, the other long side passing through a second point, wherein said first point comprises a point where a distance from the axial center of said spindle to said outline is a minimum distance, said second point comprises a point disposed opposite to said first point with respect to the axial center of the spindle, said ideal straight line comprises a line passing through said first and second points, and wherein a ratio of a length of a part of said first portion of the respective long sides, adjoining said second portion thereof and being twice the distance between said first point and a junction between said first and second portions of the long side, to a total length of the respective long sides is equal to 0.8 or less.

6. A spindle according to claim 5, wherein a length of a part of said outline on said short side is 60–95% of the maximum width of said spindle on said ideal straight line.

7. A spindle according to claim 5, wherein said outline basically comprises an ellipse.

8. A spindle assembly according to claim 5, wherein both long sides have a first portion perpendicular to said ideal straight line and at least one second portion inclined to said ideal straight line so as to extend across a corner of the rectangle and away from an adjacent spindle, and wherein a recession rate of said second portion of said long sides of said rectangle toward an inside of said rectangle and away from an adjacent spindle is less at least at one corner, and leadwires and accessories are mounted on said one corner.

9. A spindle according to claim 5, wherein fins having an uneven surface are provided at least at a portion of the inside of said outline.

10. A textile machine having a plurality of spindles and means for mounting said spindles on a spindle rail in such a manner that each spindle is subject to slight axial rotation relative to the spindle rail over a period of time of use, each of said spindles being directly driven by a respective electrical motor, wherein an outline of a periphery of an electrical motor body of said spindle, as viewed in an axial direction of said spindle, is included within a rectangle defined by:

short sides parallel to an ideal straight line passing through an axial center of said spindle, said short sides defining a maximum width of said outline, and long sides each having a first portion perpendicular to said ideal straight line and at least one section portion inclined to said ideal straight line in a direction away from an adjacent spindle so as to extend across a corner of the rectangle, said long sides having a length longer than said short sides, the first portion of one of said long sides passing through a first point and the first portion of the other long side passing through a second point, wherein said first point comprises a point where a distance from the axial center of said spindle to said outline is a minimum distance, said second point comprises a point disposed opposite to said first point with respect to the axial center, and said ideal straight line comprises a line passing through said first and second points, and wherein a ratio of a length of a part of the first portion of each of the long sides, which bounds an area of maximum width of the rectangle, to a total length of the long side is equal to 0.8 or less.

11. A textile machine according to claim 10, wherein a length of a part of said outlining on said short side is 60–95% of the maximum width of said spindle on said ideal straight line.

12. A textile machine according to claim 10, wherein said outline basically comprises an ellipse.

13. A textile machine according to claim 10, wherein a recession rate of said outline from said long side of said rectangle toward an inside of said rectangle is smaller at least at one corner, and lead wires and accessories are mounted on said smaller recession rate corner.

14. A textile machine according to claim 10, wherein fins having an uneven surface are provided at least at a portion of the inside of said outline.

* * * * *

UNITED STATES PATENT AND TRADEMARK OFFICE

CERTIFICATE OF CORRECTION

PATENT NO. : 5,444,970

DATED : August 29, 1995

INVENTOR(S) : Kobayashi et al.

It is certified that error appears in the above-identified patent and that said Letters Patent is hereby corrected as shown below:

Title apge, item
[30] Foreign Application Priority Data -- should read--
Dec. 5, 1990 [JP] Japan .....2-400454

Signed and Sealed this

Second Day of January, 1996

Attest:

Bruce Lehman

BRUCE LEHMAN

Attesting Officer

Commissioner of Patents and Trademarks